US006826852B2

(12) United States Patent
Fusco

(10) Patent No.: US 6,826,852 B2
(45) Date of Patent: Dec. 7, 2004

(54) LIGHTWEIGHT SOLE STRUCTURE FOR AN ARTICLE OF FOOTWEAR

(75) Inventor: Ciro Fusco, Portland, OR (US)

(73) Assignee: Nike, Inc., Beaverton, OR (US)

( * ) Notice: Subject to any disclaimer, the term of this patent is extended or adjusted under 35 U.S.C. 154(b) by 10 days.

(21) Appl. No.: 10/315,950

(22) Filed: Dec. 11, 2002

(65) Prior Publication Data

US 2004/0111922 A1 Jun. 17, 2004

(51) Int. Cl.[7] ..... A43B 13/16

(52) U.S. Cl. ..... 36/103; 36/129; 36/25 R; 36/27; 36/30 R; 36/28; 36/59 R; 36/59 C

(58) Field of Search ..... 36/103, 129, 7.8, 36/25 R, 27, 30 R, 28, 59 R, 59 C, 102, 29

(56) References Cited

U.S. PATENT DOCUMENTS

| | | | | | |
|---|---|---|---|---|---|
| 2,334,719 | A | * | 11/1943 | Margolin | 36/3 B |
| 3,822,490 | A | * | 7/1974 | Murawski | 36/105 |
| 4,183,156 | A | | 1/1980 | Rudy | |
| 4,219,945 | A | | 9/1980 | Rudy | |
| 4,342,158 | A | * | 8/1982 | McMahon et al. | 36/35 R |
| 4,375,728 | A | * | 3/1983 | Dassler | 36/32 R |
| 4,486,964 | A | | 12/1984 | Rudy | |
| 4,492,046 | A | | 1/1985 | Kosova | |
| 4,507,879 | A | * | 4/1985 | Dassler | 36/102 |
| 4,566,206 | A | * | 1/1986 | Weber | 36/7.8 |
| 4,607,440 | A | * | 8/1986 | Roberts et al. | 36/114 |
| 4,833,795 | A | * | 5/1989 | Diaz | 36/29 |
| 5,159,767 | A | | 11/1992 | Allen | |
| 5,203,095 | A | * | 4/1993 | Allen | 36/27 |
| 5,224,279 | A | * | 7/1993 | Agnew | 36/30 R |
| 5,353,523 | A | | 10/1994 | Kilgore et al. | |
| 5,367,790 | A | | 11/1994 | Gamow et al. | |
| 5,560,126 | A | | 10/1996 | Meschan et al. | |
| 5,701,686 | A | | 12/1997 | Herr et al. | |
| 5,806,210 | A | | 9/1998 | Meschan | |
| 6,029,374 | A | | 2/2000 | Herr et al. | |
| 6,029,962 | A | | 2/2000 | Shorten et al. | |
| 6,061,931 | A | * | 5/2000 | Kaneko | 36/129 |
| 6,324,772 | B1 | | 12/2001 | Meschan | |
| 6,487,796 | B1 | | 12/2002 | Avar et al. | |

OTHER PUBLICATIONS

Internet publication entitled "2002: Manufacturing Program," from Luxilon Industries N.V., which was on sale in this country at least one year prior to the filing date of the present application, 3 pps.

Internet publication entitled "Grilon Multifil," from EMS-Griltech, which was on sale in this country at least one year prior to the filing date of the present application, 5 pps.

* cited by examiner

*Primary Examiner*—Ted Kavanaugh
(74) *Attorney, Agent, or Firm*—Banner & Witcoff, Ltd.

(57) ABSTRACT

The invention is an article of footwear having an upper and a sole structure. The sole structure includes a moderator plate and a traction plate. The moderator plate is attached to the upper and the traction plate is attached to the moderator plate, thereby forming a void between the plates. The traction plate functions as a ground-engaging portion of the sole and includes a plurality of projections that provide traction. In addition, the projections may be structured to attenuate impact forces and absorb energy during the running cycle.

31 Claims, 6 Drawing Sheets

LIGHTWEIGHT SOLE STRUCTURE FOR AN ARTICLE OF FOOTWEAR

BACKGROUND OF THE INVENTION

1. Field of the Invention

The present invention relates to footwear. The invention concerns, more particularly, an article of footwear having a lightweight sole structure formed of two coextensive plates.

2. Description of Background Art

The success of an athlete during modern athletic competitions is often dependent upon distances on the order of millimeters and differences in time that are measured in hundredths of a second. The overall weight of an athlete, which includes the weight of the athlete's apparel and footwear, substantially affects the performance and success of the athlete during competitions. In order to gain an advantage over competitors, athletes often select footwear that performs in accordance with the demands of modern athletic standards, but with decreased weight when compared to other articles of footwear designed for the same purpose.

Conventional articles of footwear include two primary elements, an upper and a sole structure. The upper comfortably and securely receives the foot and is often formed of multiple layers of foam, leather, and textile materials that are stitched and adhesively bonded together. The sole structure is typically formed of multiple layers, including a midsole and an outsole. In addition, the sole structure may include an insole that is generally located within the upper and adjacent to the sole of the foot in order to enhance the comfort of the footwear.

The midsole forms the middle layer of the sole and often includes a resilient, foam material, such as polyurethane or ethylvinylacetate, that attenuates impact forces and absorbs energy when the footwear makes contact with the ground. That is, the compressive properties of the midsole act to reduce forces experienced by the foot during competitions. In general, an increase in midsole thickness also increases the force attenuating and energy absorbing characteristics of the midsole. In a detrimental sense, however, an increase in midsole thickness also increases the weight of the footwear and decreases the stability of the sole structure. In designing footwear midsoles, therefore, footwear manufacturers attempt to achieve a suitable balance between forces experienced by the foot, overall weight of the midsole, and stability. In order to increase the force attenuating and energy absorbing properties of midsoles without substantially increasing weight or decreasing stability, many modern midsole structures incorporate a fluid-filled bladder, as disclosed in U.S. Pat. Nos. 4,183,156 and 4,219,945 to Marion F. Rudy.

The outsole is attached to the lower surface of the midsole and is usually fashioned from a durable, wear-resistant polymer. The outsole functions as the ground-engaging surface of the footwear and often includes texturing to provide the footwear with traction, or resistance to slipping. Outsoles designed specifically for track and field running competitions may also include a spike plate that is attached to the outsole in at least the forefoot region. The spike plate includes a series of recesses that receive removable metal spikes for supplementing the traction properties of the outsole.

Based upon the above discussion, the sole structure of certain conventional articles of footwear includes two primary elements, a midsole and an outsole, that combine to provide the footwear with two fundamental characteristics. That is, the midsole attenuates impact forces and absorbs energy, and the outsole provides traction. In footwear designs where the midsole and outsole do not provide an optimum degree of force attenuation, energy absorption, or traction, the sole structure may also incorporate addition elements, such as a fluid-filled bladder and spike plate. The plurality of components that comprise modem sole structures may be inefficient to manufacture and have the potential to detrimentally affect the performance of an athlete by adding weight to the footwear.

SUMMARY OF THE INVENTION

The present invention relates to an article of footwear that includes an upper for receiving a foot of a wearer and a sole structure. The sole structure includes a moderator plate and a traction plate. The moderator plate is attached to the upper and the traction plate is attached to the moderator plate. The traction plate includes a plurality of upward projections and a plurality of downward projections that are structured to attenuate impact forces and absorb energy when the footwear contacts the ground. The upward projections are attached to the moderator plate, and the downward projections engage the ground and provide traction.

The moderator plate is generally contoured to conform to the shape of the foot, particularly the sole of the foot, and includes a raised heel region and a lower forefoot region. In addition, the moderator plate includes a raised area for supporting the arch.

The traction plate may be configured for use during a plurality of activities. When configured for use during long distance track and field running events, the traction plate may have a high density of upward and downward projections in the heel and forefoot regions. Projections in these regions ensure that the wearer has sufficient traction when the heel region makes contact with the ground and when the forefoot region disengages the ground. In addition, the projections attenuate impact forces and absorb energy. The traction plate may also include tip members that are attached to the distal points of the downward projections to enhance traction on specific surfaces.

The tips of the upward projections may be attached to the lower surface of the moderator plate. This configuration forms a void between the moderator plate and the traction plate. Whereas conventional sole structures include a foam midsole, an outsole, and additional elements, the sole of the present invention includes the moderator plate and traction plate. The sole structure of the present invention provides a lightweight article of footwear, when compared to conventional footwear, that may be configured for use during a variety of athletic or non-athletic activities.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
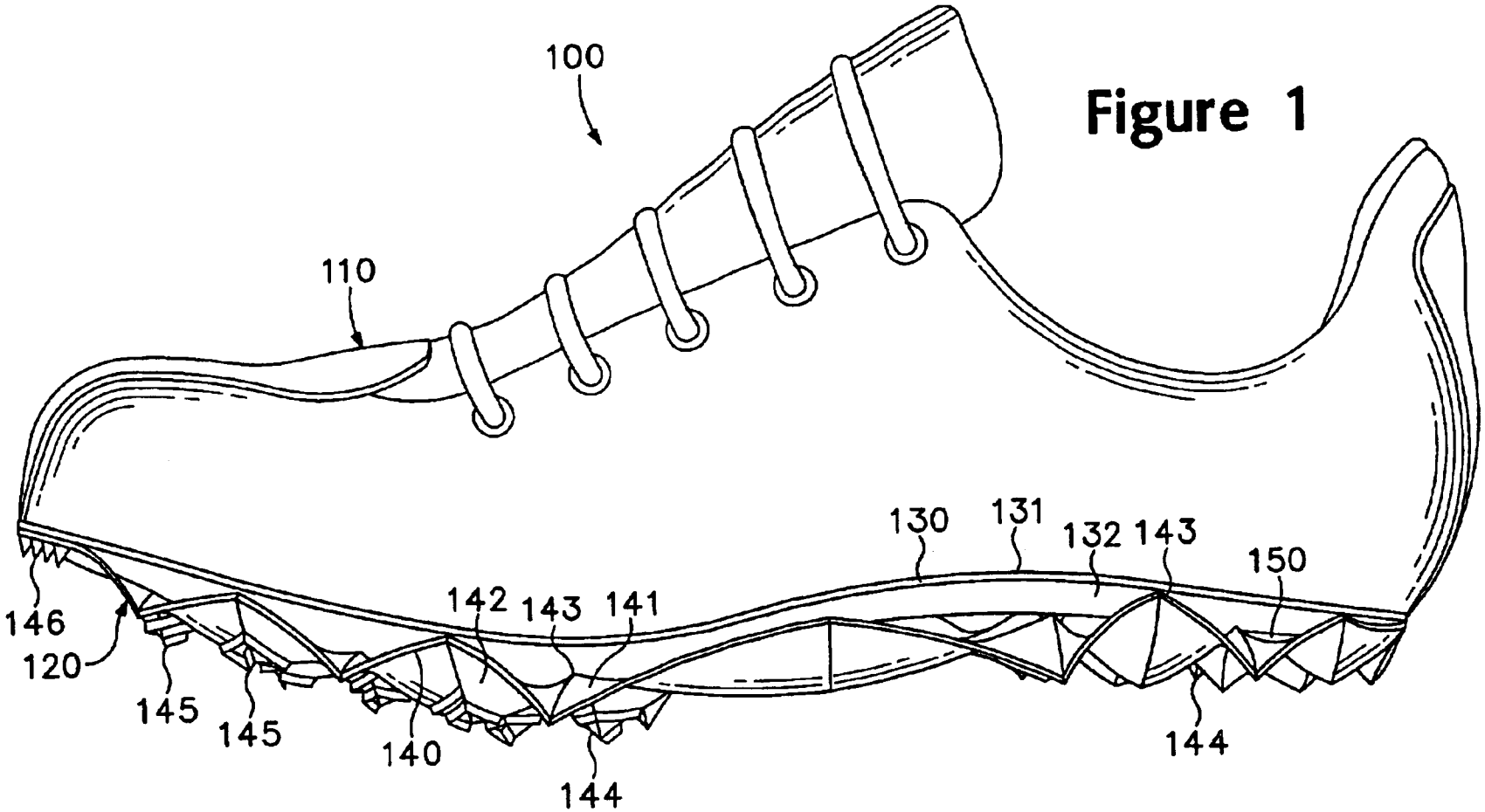
FIG. 1 is a lateral elevational view of an article of footwear in accordance with the present invention.
Figure 2:
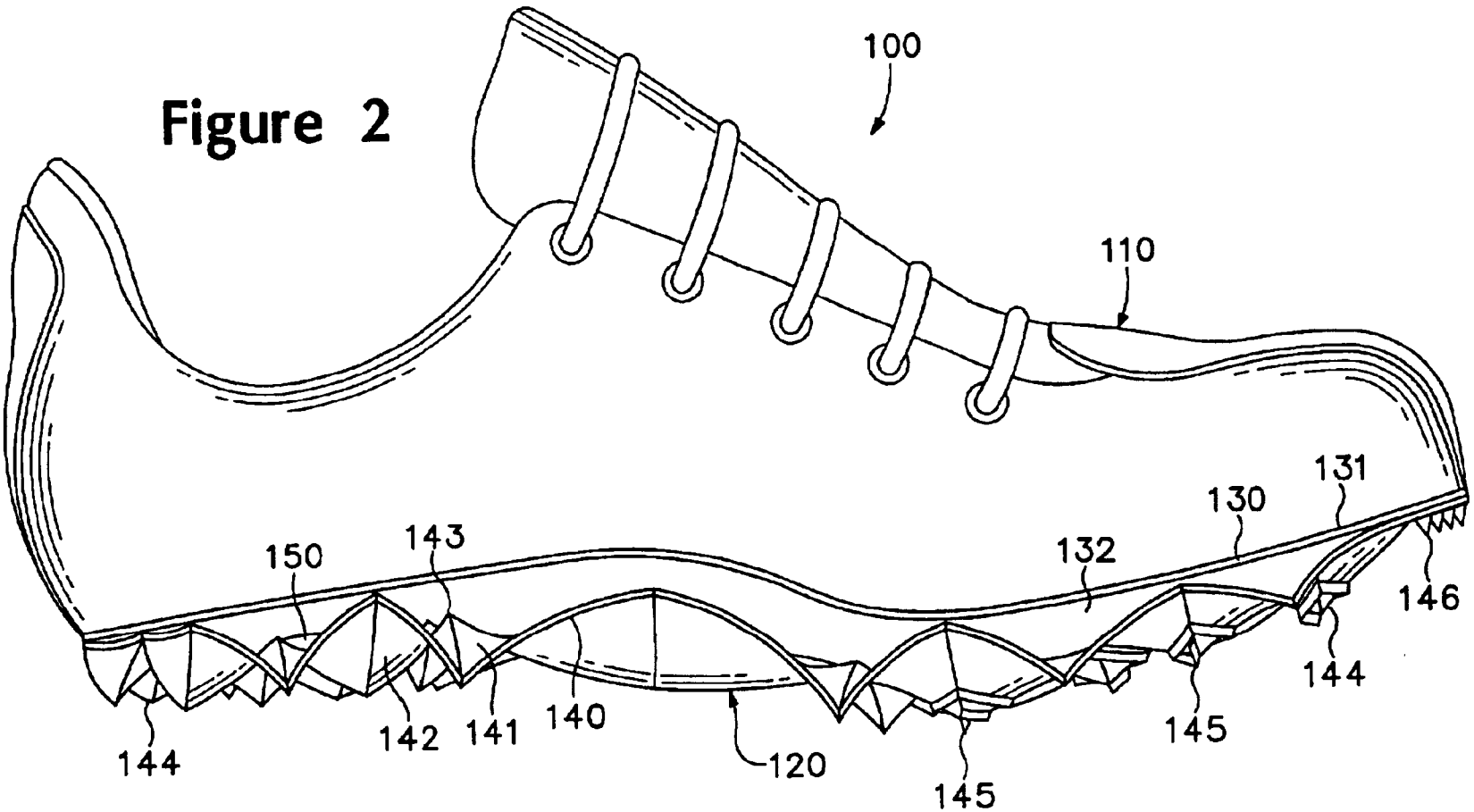
FIG. 2 is a medial elevational view of the article of footwear depicted in FIG. 1.

Referring to the drawings, wherein like numerals indicate like elements, an article of footwear 100 in accordance with the present invention is disclosed. Footwear 100 is depicted in FIGS. 1 and 2 as an article of athletic footwear, particularly a long distance running shoe that is suitable for track and field competitions. The concepts disclosed with reference to footwear 100, however, may be applied to any style of athletic footwear, including footwear designed for sprinting, basketball, tennis, cross-training, and hiking, for example. In addition, the concepts may be applied to numerous types of non-athletic footwear, including sandals, work boots, and dress shoes. The present invention, therefore, is not limited to footwear designed solely for track and field competitions involving long distance running, but may also be applied to a wide range of other footwear styles.

The primary elements of footwear 100 are an upper 110 that is connected to a sole structure 120. Upper 110 may be any style of conventional upper that receives and comfortably secures footwear 100 to a foot of a wearer. Sole structure 120, which is generally located beneath the sole of the foot, attenuates shock and absorbs energy when footwear 100 repetitively contacts the ground during athletic activity. In addition, sole structure 120 is wear-resistant and provides traction.

Sole structure 120 is depicted in FIGS. 3–9 and may include an insole (not shown) that is located within upper 110 and adjacent to the sole of the wearer's foot to enhance the comfort of footwear 100. In addition, sole structure 120 includes a moderator plate 130 and a traction plate 140. As discussed in the Description of Background Art section, conventional articles of footwear generally include a sole structure having a midsole and an outsole. Conventional footwear designed for use during long distance track and field running events also include a spike plate. Sole structure 120 of footwear 100, however, combines the functions of the midsole, outsole, and spike plate. Accordingly, moderator plate 130 and traction plate 140 combine to form a single structure that attenuates shock, absorbs energy, and provides traction. In addition, the weight of moderator plate 130 and traction plate 140 is significantly less than the combined weight of prior art sole structures, thereby providing footwear 100 with a lesser overall weight. Whereas conventional footwear that is suitable for long distance track and field running events may have an overall weight of approximately 4.3 ounces, for men's size 9 U.S., a similarly sized footwear 100 may have an overall weight that ranges between 3 and 3.5 ounces. Sole structure 120 is, therefore, more lightweight than conventional sole designs. In addition, sole structure 120, which includes only moderator plate 130 and traction plate 140, is more efficient to manufacture, thereby reducing the overall cost of footwear 100 when compared with conventional footwear.

Figure 3:
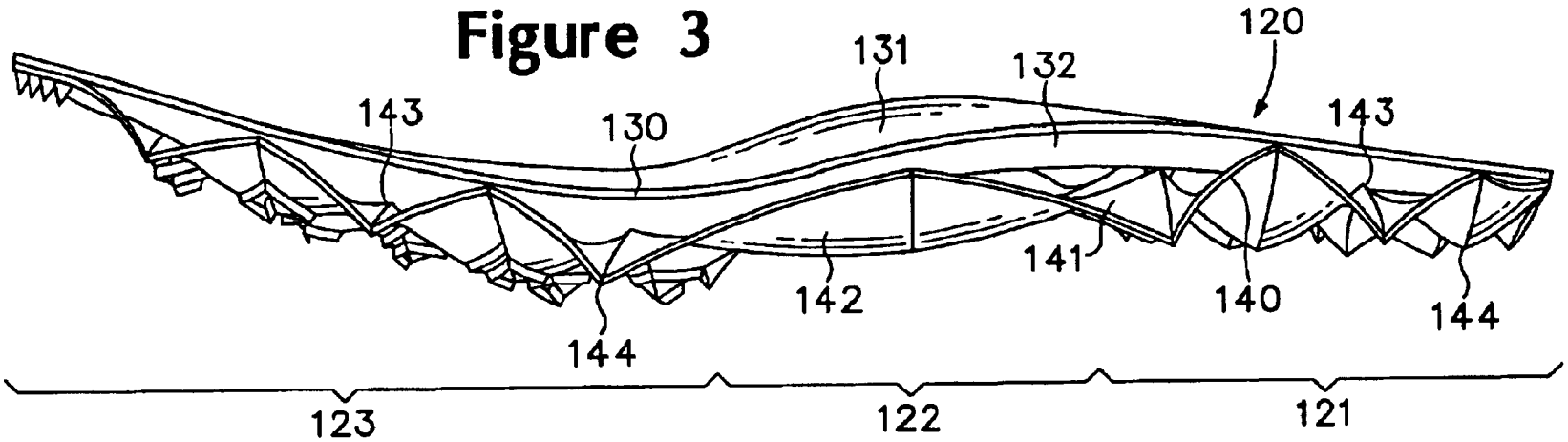
FIG. 3 is a lateral elevational view of a sole structure in accordance with the present invention.
Figure 4:
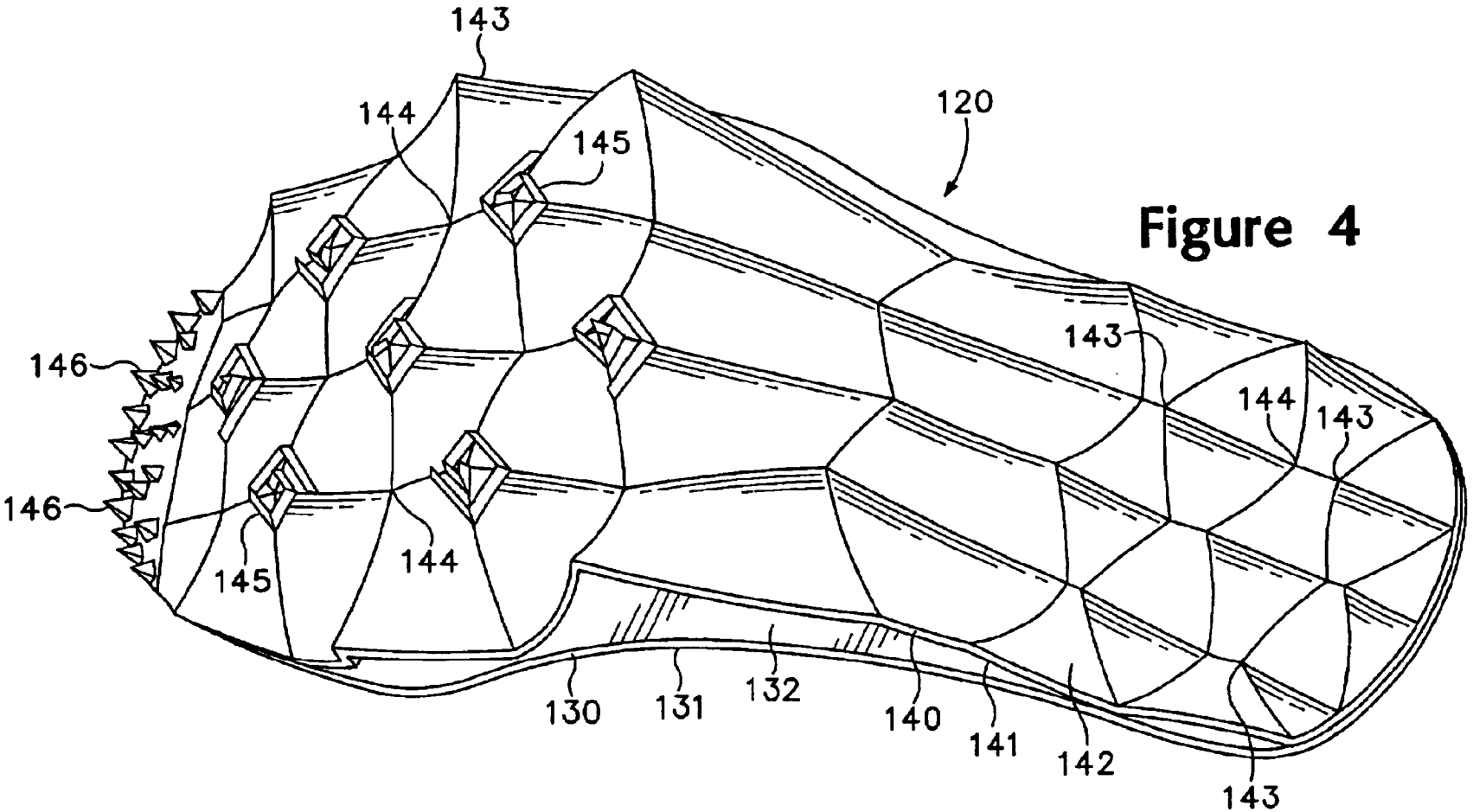
FIG. 4 is a perspective view of the sole structure.
Figure 5:
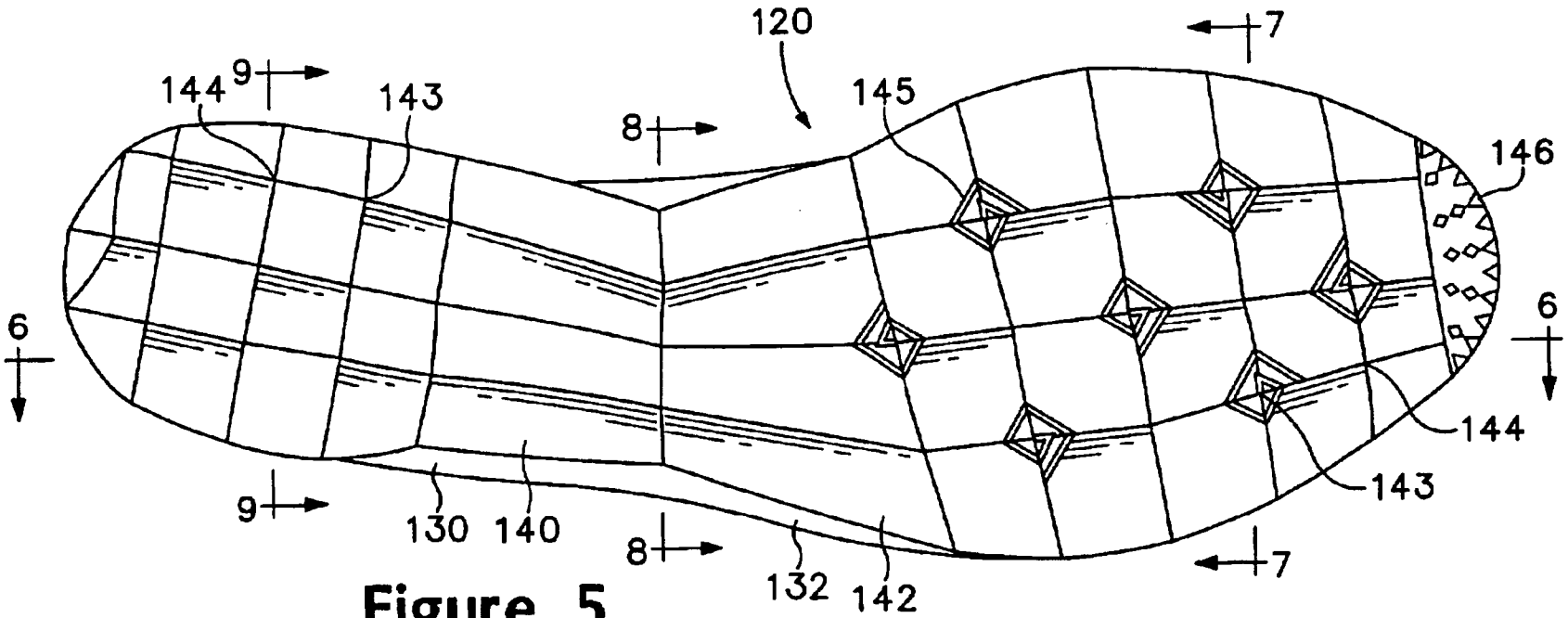
FIG. 5 is a bottom plan view of the sole structure.
Figure 6:
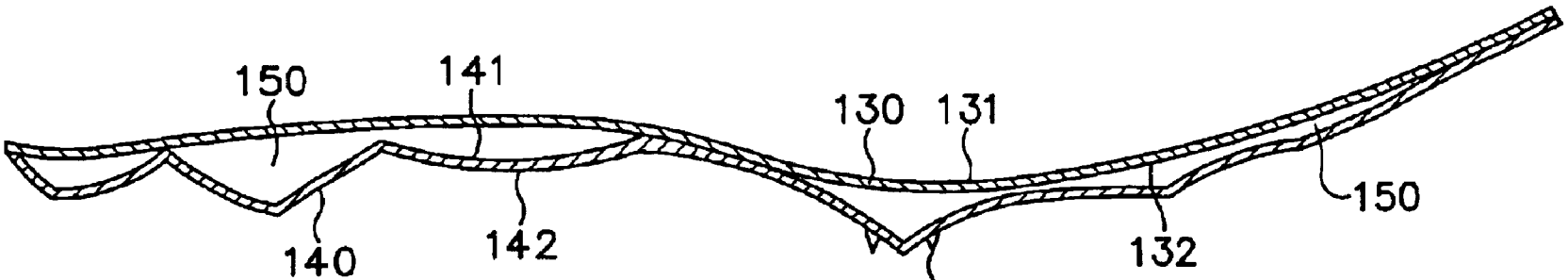
FIG. 6 is a cross-sectional view of the sole structure as defined by line 6—6 in FIG. 5.
Figure 9:
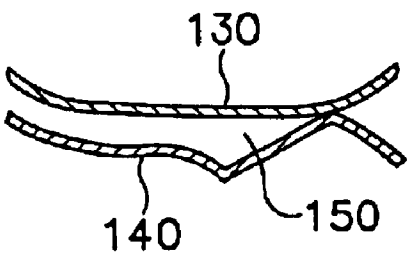
FIG. 9 is a cross-sectional view of the sole structure as defined by line 9—9 in FIG. 5.
Figure 8:
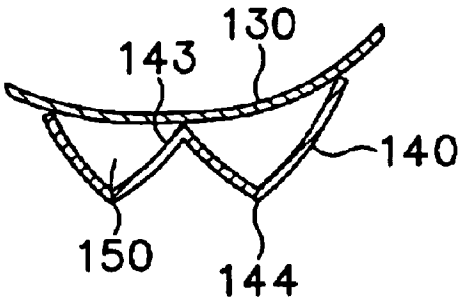
FIG. 8 is a cross-sectional view of the sole structure as defined by line 8—8 in FIG. 5.
Figure 7:
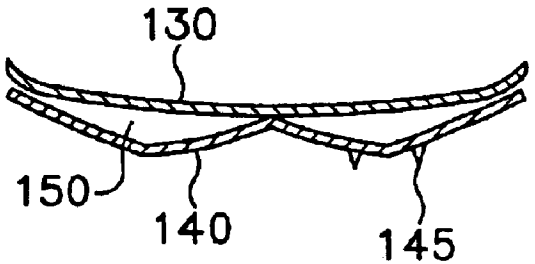
FIG. 7 is a cross-sectional view of the sole structure as defined by line 7—7 in FIG. 5.

The structural attributes of sole structure 120, including moderator plate 130 and traction plate 140, will now be discussed in greater detail. To aid in the following discussion, and as depicted in FIG. 3, sole structure 120 may be divided into three general regions: a heel region 121, which is located in an aft portion of footwear 100 and generally underlies the heel of the foot; a midfoot region 122, which is located in a mid-portion of footwear 100 and generally underlies an arch of the foot; and a forefoot region 123, which is located in a fore portion of footwear 100 and generally underlies forward portions of the metatarsals and the toes.

Moderator plate 130 is a single, contoured plate that includes an upper surface 131 and a lower surface 132. Upper surface 131 is attached to upper 110 and is generally contoured in accordance with the shape of a human foot, thereby providing the foot with support during running or walking. The contours of upper surface 131 include the following attributes: First, the portion of moderator plate 130 located within heel region 121 is generally raised in relation to the portion of moderator plate 130 located within forefoot region 123. Second, the portion of moderator plate 130 located within heel region 121 also includes a depression for receiving the heel of the wearer's foot. During running or other activities that compress sole structure 120, the heel depression ensures that the heel remains positioned above the center of sole structure 120 such that peak compressive loads act across substantially the entire width of heel region 121, rather than on a single side of heel region 121. Third, the area of moderator plate 130 corresponding with midfoot portion 122 functions as a transition between the raised heel portion and the lower forefoot portion and includes a raised arch that provides additional support for the medial side of the foot. Fourth, the portion of moderator plate 130 corresponding with forefoot region 123 generally slopes upward in forward areas of the forefoot portion. Finally, the periphery of moderator plate 130 is generally raised in relation to interior portions, thereby providing a downward depression in which the foot is positioned when the foot is received by footwear 100.

Traction plate 140 provides footwear 100 with a durable, ground-engaging element that attenuates shock, absorbs energy, and provides traction. Traction plate 140 includes an upper surface 141 and an opposite lower surface 142. Upper surface 141 is directly attached to lower surface 132 of moderator plate 130. The attachment between moderator plate 130 and traction plate 140 may be accomplished, for example, with adhesives, heat bonding, or a combination thereof The interstitial area between moderator plate 130 and traction plate 140 will generally form a void 150, as depicted in the figures. Lower surface 142 is positioned to directly engage the ground.

Traction plate 140 is molded such that upper surface 141 and lower surface 142 have a plurality of corresponding contours. Although moderator plate 130 is also contoured, upper surface 131 and lower surface 132 are generally smooth to provide a comfortable surface for supporting the foot. Traction plate 140, however, has a plurality of undulating contours that are specifically structured to attenuate impact forces, absorb energy, and provide traction. The contours of traction plate 140 are generally concentrated in the areas that correspond with heel region 121 and forefoot region 123. For purposes of the following discussion, the contours may be generally classified as upward projections 143 and downward projections 144. Upward projections 143 form protrusions on upper surface 141 and indentations in lower surface 142. Similarly, downward projections 144 form protrusions on lower surface 142 and indentations in upper surface 141. Within the scope of the present invention, projections 143 and 144 may have a variety of configurations, including pointed structures and rounded structures, for example. In addition, projections 143 and 144 may be textured or smooth. As depicted in the Figures, traction plate 140 includes both upward projections 143 and downward projections 144. In further embodiments, however, traction plate 140 may be designed to include only downward projections 144, for example.

The manner in which traction plate 140 attenuates impact forces and absorbs energy is most evident when compared with barefoot running, wherein the foot makes direct contact with the ground. While running, an athlete generally has a forward component of motion. In addition, the athlete has either a downward component of motion or an upward component of motion depending upon the specific stage of the running cycle. At the moment just prior to the time when the foot contacts the ground, the athlete has both forward motion and downward motion. As the foot makes contact with the ground, the foot experiences ground reaction forces that oppose further downward motion. Accordingly, the downward motion of the body ceases in a relatively short period of time after the foot makes contact with the ground. During barefoot running, therefore, the momentum forces associated with ceasing downward motion are significant and absorbed by the structure of the foot and leg. As traction plate 140 makes contact with the ground, however, projections 143 and 144 deflect or bend. The deflection ceases the downward movement of the body, but over a longer period of time than with barefoot running. This serves to attenuate impact forces. In addition, the deflection in traction plate 140 absorbs a portion of the energy associated with ceasing the downward motion of the athlete, thereby decreasing the energy absorbed by the structure of the foot and leg. Consequently, traction plate 140 attenuates impact forces and absorbs energy during the running cycle.

Referring to the figures, specifically the cross-sectional views of FIGS. 6–9, projections 143 and 144 form a zigzag shaped structure, with upward projections 143 and downward projections 144 forming the angles of the zigzag structure. As discussed above, compressive forces associated with the downward motion of the athlete tend to deflect this structure. One skilled in the relevant art will recognize that projections 143 and 144 behave in a manner analogous to a spring. Accordingly, initial deflections of projections 143 and 144 occur with relatively small compressive forces and as deflection continues greater compressive forces are required to gain additional deflection. When traction plate 140 is in the deflected state, the compressive forces are also stored by projections 143 and 144 such that projections 143 and 144 return to their original shape following removal of the compressive forces, thereby releasing absorbed energy.

In addition to impact force attenuation and energy absorption, traction plate 140 also provides traction. Downward projections 144 may be configured to have pointed ends, as depicted in the figures. When in contact with the ground, the pointed ends engage depressions, crevices, cracks, or holes in the ground. In compliant surfaces, such as a rubber track, the pointed ends of downward projections 144 will protrude into the surface. In this manner, movement between traction plate 140 and the ground is greatly restricted, thereby providing traction. When footwear 100 is designed for other athletic activities where additional traction is necessary, recesses may be formed in selected downward projections 144 that accommodate spikes or other supplemental traction devices. Accordingly, traction plate 140 may have a variety of configurations within the scope of the present invention that promote traction.

In designing traction plate 140, a variety of factors may be altered to provide specific impact force attenuation, energy absorbing, and traction characteristics, including the height of projections 143 and 144, the thickness of traction plate 140, the density of projections 143 and 144, and the material utilized to form traction plate 140. By altering these factors, the characteristics of traction plate 140 may be altered and a plurality of different traction plates 140 may be formed in a manner that is suitable for a variety of different activities.

As depicted in the figures, projections 143 and 144 are primarily located in heel region 121 and forefoot region 123. The rationale behind this configuration relates to the motion of footwear 100 during running, which is described as follows: Initially, heel region 121 strikes the ground. Footwear 100 then rolls forward such that forefoot region 123 makes contact with the ground. Heel region 121 then disengages the ground such that only forefoot region 123 remains in contact. Finally, all of footwear 100 leaves the ground and another cycle begins. When heel region 121 initially strikes the ground, traction plate 140 experiences significant ground reaction forces. Traction plate 140 includes, therefore, a plurality of projections 143 and 144 in heel region 121. The plurality of projections 143 and 144 in heel region 121 not only attenuate impact forces and absorb energy, but also provide traction when footwear 100 initially contacts the ground. As footwear 100 rolls forward and heel region 121 disengages the ground, forefoot region 123 experiences a significant degree of forces. Accordingly, forefoot region 123 of traction plate 140 also includes a plurality of projections 143 and 144. The forces experienced by forefoot region 123 are generally less than the forces experienced by heel region 121. Accordingly, projections 143 and 144 in forefoot region 123 have less height and are less dense in comparison with projections 143 and 144 in heel region 121.

During sprinting, the motion of the foot varies from the motion described above. Whereas heel region 121 initially contacts the ground during long distance running or running at lower velocities, only forefoot region 123 of the foot contacts the ground during sprinting. Accordingly, the prevalence of projections 143 and 144 in heel region 121 may be less than in forefoot region 123 to reflect the motion of the foot during sprinting.

The dimensions of moderator plate 130 and traction plate 140 may vary significantly within the scope of the present invention. In general, as the size of footwear 100 increases, the weight of the wearer also increases. Designers of footwear have access to information that generally correlates footwear size with the weight of the wearer. The thickness and other dimensions of moderator plate 130 and traction plate 140 may increase, therefore, in proportion to the size of the foot that footwear 100 is intended to accommodate or the overall weight of the wearer.

Moderator plate 130 and traction plate 140 may be formed from a variety of materials, including polymers and lightweight metals that form a semi-rigid structure. One suitable polymer material for moderator plate 130 and traction plate 140 is a high flex modulus polyether block amide, such as PEBAX, which is manufactured by the Atofina Company.

Polyether block amide provides a variety of characteristics that benefit the present invention, including high impact resistance at low temperatures, few property variations in the temperature range of −40 degrees Celsius to positive 80 degrees Celsius, resistance to degradation by a variety of chemicals, and low hysteresis during alternative flexure. In addition, moderator plate 130 and traction plate 140 may be formed from a nylon material, such as ZYTEL, which is manufactured by E.I. du Pont de Nemours and Company. Nylon materials offers efficient molding, high toughness and impact resistance, and abrasion resistance, for example.

Polyether block amide and nylon may not provide sufficient traction on some surfaces, such as a polished wood surface or ceramic tile surface. In order to provide traction on these surfaces, tip members 145 may be added to selected downward projections 144. Tip members 145 may be formed of a durable rubber material, such as the material conventionally utilized for an outsole, that has a relatively high coefficient of friction on such surfaces. As depicted in the figures, tip members 145 are located in seven downward projections 144 that are distributed across forefoot region 123. In addition, traction plate 140 may include a plurality of tip members 146, which are also formed of a rubber material, in forward portions of forefoot region 123 to provide additional traction during toe-off. Tip members 145 may be molded onto downward projections 144 or molded separately and subsequently attached.

An advantage to forming moderator plate 130 and traction plate 140 from polymer materials relates to manufacturing efficiency. Both moderator plate 130 and traction plate 140 may be formed through two-plate injection molding processes. Following the formation of individual plates 130 and 140, a bond may for formed between plates 130 and 140. Tip members 145 and 146 may then be secured to lower surface 142, thereby completing the manufacture of sole structure 120. This process is not only more efficient than the manufacturing processes for conventional sole structures, but also produces a sole structure having lesser weight. As discussed in the Description of Background Art section, the weight of an article of footwear may significantly affect an athlete's performance. Article of footwear 100, therefore, is suitable for use in the variety of athletic competitions where millimeters or hundredths of a second determine the success of an athlete.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear having an upper for receiving a foot of a wearer and a sole structure attached to said upper, said sole structure comprising:

a first plate and a second plate in a coextensive configuration and formed of a semi-rigid material, said first plate and said second plate extending along substantially all of a length of said footwear, said first plate being positioned adjacent said upper and said second plate being connected to said first plate, said first plate being contoured to conform with a shape of the foot and include a depression in a heel region of said footwear for receiving a heel of the foot, and said second plate having a contoured configuration that includes a plurality of projections; and a void located between said first plate and said second plate.

2. The article of footwear of claim 1, wherein said projections include a plurality of upward projections and a plurality of downward projections.

3. The article of footwear of claim 2, wherein at least one of said upward projections is bonded to said first plate, thereby connecting said second plate to said first plate.

4. The article of footwear of claim 2, wherein said downward projections form a plurality of pointed structures for engaging the ground.

5. The article of footwear of claim 2, wherein said upward projections and said downward projections are substantially located in a heel region of said footwear and a forefoot region of said footwear.

6. The article of footwear of claim 2, wherein a tip member is attached to at least one of said downward projections.

7. The article of footwear of claim 6, wherein said tip member is formed of a resilient traction material.

8. The article of footwear of claim 1, wherein said first plate has a first elevation in a heel region of said footwear and a second elevation in a forefoot region of said footwear, said first elevation being greater than said second elevation.

9. The article of footwear of claim 1, wherein said first plate includes a raised area in a midfoot region for supporting an arch of the foot.

10. An article of footwear having an upper for receiving a foot of a wearer and a sole structure attached to said upper, said sole structure comprising:

a first plate and a second plate in a coextensive configuration and formed of a semi-rigid material, said fist plate and said second plate extending along substantially all of a length of said footwear, said first plate being positioned adjacent said upper and said second plate being positioned adjacent to said first plate and opposite said upper, said first plate being contoured to conform with a shape of the foot and include a depression in a heel region of said footwear for receiving a heel of the foot, and said second plate being contoured to include a plurality of upward projections and downward projections, at least one of said upward projections being bonded to said first plate to connect said second plate to said first plate; and a void located between said first plate and said second plate.

11. The article of footwear of claim 10, wherein said downward projections form a plurality of pointed structures for engaging the ground.

12. The article of footwear of claim 10, wherein said upward projections and said downward projections are substantially located in a heel region of said footwear and a forefoot region of said footwear.

13. The article of footwear of claim 10, wherein a plurality of tip members are attached to selected said downward projections.

14. The article of footwear of claim 13, wherein said tip member is formed of a resilient traction material.

15. The article of footwear of claim 10, wherein said first plate has a first elevation in a heel region of said footwear and a second elevation in a forefoot region of said footwear, said first elevation being greater than said second elevation.

16. The article of footwear of claim 10, wherein said first plate includes a raised area in a midfoot region for supporting an arch of the foot.

17. An article of footwear having an upper for receiving a foot of a wearer and a sole structure, said sole structure comprising:

a first plate underlying said upper and attached to said upper, said first plate extending along substantially all of a length of said footwear, and said first plate being contoured to include:

a first elevation in a heel region of said footwear and a second elevation in a forefoot region of said footwear, said first elevation being greater than said second elevation, a raised area in a midfoot region of said footwear for supporting an arch of the foot, and a depression in said heel region for supporting a heel of the foot;

a second plate positioned in a coextensive configuration with said first plate and opposite said upper relative to said first plate, said second plate extending along substantially all of a length of said footwear, and said second plate including a plurality of upward projections and a plurality of downward projections structured to attenuate impact forces and absorb energy, selected said upward projections being bonded to said first plate to connect said second plate to said first plate, and said downward projections being positioned to engage the ground and provide traction; and a void located between said first plate and said second plate.

18. The article of footwear of claim 17, wherein a tip member is attached to at low one of said downward projections.

19. The article of footwear of claim 18, wherein said tip member is formed of a rubber material.

20. The article of footwear of claim 17, wherein said first plate and said second plate are formed of a semi-rigid material.

21. The article of footwear of claim 20, wherein said semi-rigid material is selected from a group consisting of nylon and polyether block amide.

22. An article of footwear having an upper for receiving a foot of a wearer and a sole structure, said sole structure comprising at least two plates in a coextensive configuration that extend along substantially all of a length of said upper, said plates forming a void in said sole structure, and said plates including:

a moderator plate attached to said upper, at least an upper surface of said moderator plate having a contoured configuration that conforms to a shape of the foot; and a traction plate positioned opposite said upper relative to said moderator plate and located to engage a ground surfaces, said traction plate including a plurality of upward projections and a plurality of downward projection structured to attenuate impact forces and absorb energy, at least one of said upward projections being bonded to said moderator plate.

23. The article of footwear of claim 22, wherein said downward projections are generally pointed structures.

24. The article of footwear of claim 22, wherein a tip member is attached to at least one of said downward projections.

25. The article of footwear of claim 24, wherein said tip member is formed of a rubber material.

26. The article of footwear of claim 22, wherein said plates are formed of a semi-rigid material.

27. The article of footwear of claim 26, wherein said semi-rigid material is selected from a group consisting of nylon and polyether block amide.

28. An article of footwear having an upper for receiving a foot of a wearer and a sole structure attached to said upper, at least a portion of said sole structure consisting of:

a first plate and a second plate in a coextensive configuration and formed of a semi-rigid material, said first plate being positioned adjacent an upper of said footwear to support a foot, and said second plate being connected to said first plate and located to engage a ground surface, at least said second plate having a contoured configuration that includes a plurality of projections structured to attenuate impact forces and absorb energy; and a void located between said first plate and said second plate.

29. The sole structure of claim 28, wherein said projections include a plurality of upward projections and a plurality of downward projections.

30. The sole structure of claim 29, wherein at least one of said upward projections is bonded to said first plate, thereby connecting said second plate to said fit plate.

31. The sole structure of claim 28, wherein said first plate is contoured to conform with a shape of the foot.

* * * * *